US008016452B2

(12) United States Patent
Dunn

(10) Patent No.: US 8,016,452 B2
(45) Date of Patent: Sep. 13, 2011

(54) ADVERTISING DISPLAYS

(75) Inventor: William Dunn, Alpharetta, GA (US)

(73) Assignee: Manufacturing Resources International, Inc., Alpharetta, GA (US)

( * ) Notice: Subject to any disclaimer, the term of this patent is extended or adjusted under 35 U.S.C. 154(b) by 403 days.

(21) Appl. No.: 12/266,749

(22) Filed: Nov. 7, 2008

(65) Prior Publication Data

US 2009/0241388 A1 Oct. 1, 2009

Related U.S. Application Data

(63) Continuation-in-part of application No. 12/209,841, filed on Sep. 12, 2008, and a continuation-in-part of application No. 12/235,232, filed on Sep. 22, 2008.

(60) Provisional application No. 61/060,504, filed on Jun. 11, 2008, provisional application No. 61/061,032, filed on Jun. 12, 2008, provisional application No. 61/060,575, filed on Jun. 11, 2008.

(51) Int. Cl.
*F21V 11/00* (2006.01)

(52) U.S. Cl. ..... 362/240; 362/246; 362/293

(58) Field of Classification Search ..... 362/97.1, 362/97.2, 97.3, 240, 246, 249.02, 293, 646, 362/631; 40/471
See application file for complete search history.

(56) References Cited

U.S. PATENT DOCUMENTS

| | | | | |
|---|---|---|---|---|
| 1,812,919 | A * | 7/1931 | Balder | 40/471 |
| 3,510,973 | A * | 5/1970 | Mazzocco, Sr. | 40/471 |
| 5,493,802 | A | 2/1996 | Simson | |
| 5,717,424 | A | 2/1998 | Simson et al. | |
| 5,755,050 | A * | 5/1998 | Aiken | 40/471 |
| 6,748,685 | B2 | 6/2004 | Peel | |
| 6,949,772 | B2 * | 9/2005 | Shimizu et al. | 362/249.02 |
| 7,052,152 | B2 | 5/2006 | Harbers et al. | |
| 7,284,874 | B2 * | 10/2007 | Jeong et al. | 362/97.1 |
| 7,324,080 | B1 | 1/2008 | Hu et al. | |

* cited by examiner

*Primary Examiner* — Y My Quach Lee
(74) *Attorney, Agent, or Firm* — Stanley Law Group LLP

(57) ABSTRACT

Exemplary embodiments comprise static and dynamic advertising displays where the backlight is provided by any one of the following: LED's, organic light emitting diodes (OLED), field emitting display (FED), light emitting polymer (LEP), and organic electro-luminescence (OEL). The backlights for both the static and dynamic advertising displays may be constructed of multiple tiles of lights, such that a single tile may be replaced without having to replace the entire backlight assembly. The display may be mounted on a vertical surface, and components may be repaired or replaced without having to remove the entire display from its mounted position.

19 Claims, 10 Drawing Sheets

430
507

506
430

700
420
490
430

700
420
490
430

800
805
105

825
830
840

ADVERTISING DISPLAYS

CROSS-REFERENCE TO RELATED APPLICATIONS

This application is a continuation-in-part of U.S. application Ser. No. 12/209,841 filed Sep. 12, 2008, which claims priority to U.S. Provisional Application No. 61/060,504, filed on Jun. 11, 2008, which are herein incorporated by reference in their entirety. This application is a continuation-in-part of U.S. application Ser. No. 12/235,232 filed Sep. 22, 2008, which claims the benefit of U.S. Application No. 61/061,032, filed on Jun. 12, 2008, which are herein incorporated by reference in their entirety. This application is also a non-provisional patent application and claims priority to U.S. Provisional Application No. 61/060,575, filed on Jun. 11, 2008.

TECHNICAL FIELD

The various embodiments relate generally to advertising displays and backlight systems therefore. Exemplary displays comprise backlights which are comprised of a plurality of any one of the following: LED's, organic light emitting diodes (OLED), field emitting display (FED), light emitting polymer (LEP), or organic electro-luminescence (OEL) lights.

BACKGROUND OF THE ART

Common static advertising displays essentially comprise a front graphic which may be backlit by a fluorescent lighting assembly. The front graphic is typically screen printed onto a plastic substrate and cannot be changed unless a new graphic is manually substituted for the first graphic. Environmental concerns have raised various issues relating to fluorescent backlights. High energy consumption, relatively short life span, relative size, and the use of toxic materials are some of the concerns over fluorescent lighting.

Dynamic advertising displays, which are capable of scrolling through a plurality of images, may also utilize a backlight. Typically, this backlight is also comprised of fluorescent lights. Again, concerns over energy consumption, relative size, and toxic materials have prompted the need for a better backlight system for advertising displays.

SUMMARY OF THE EXEMPLARY EMBODIMENTS

Exemplary embodiments comprise static and dynamic advertising displays where the backlight is provided by any one of the following: LED's, organic light emitting diodes (OLED), field emitting display (FED), light emitting polymer (LEP), and organic electro-luminescence (OEL).

The backlights for both the static and dynamic advertising displays may be constructed of multiple tiles of lights, such that a single tile may be replaced without having to replace the entire backlight assembly. An electronic display backlight which is comprised of multiple tiles of lights is described in U.S. Application No. 61/060,504, incorporated entirely herein by reference. The display may be mounted on a vertical surface, and components may be repaired or replaced without having to remove the entire display from its mounted position.

BRIEF DESCRIPTION OF THE DRAWINGS

A better understanding of the exemplary embodiments of the invention will be had when reference is made to the accompanying drawings, wherein identical parts are identified with identical reference numerals, and wherein.

DETAILED DESCRIPTION OF PREFERRED EMBODIMENTS

Figure 1:
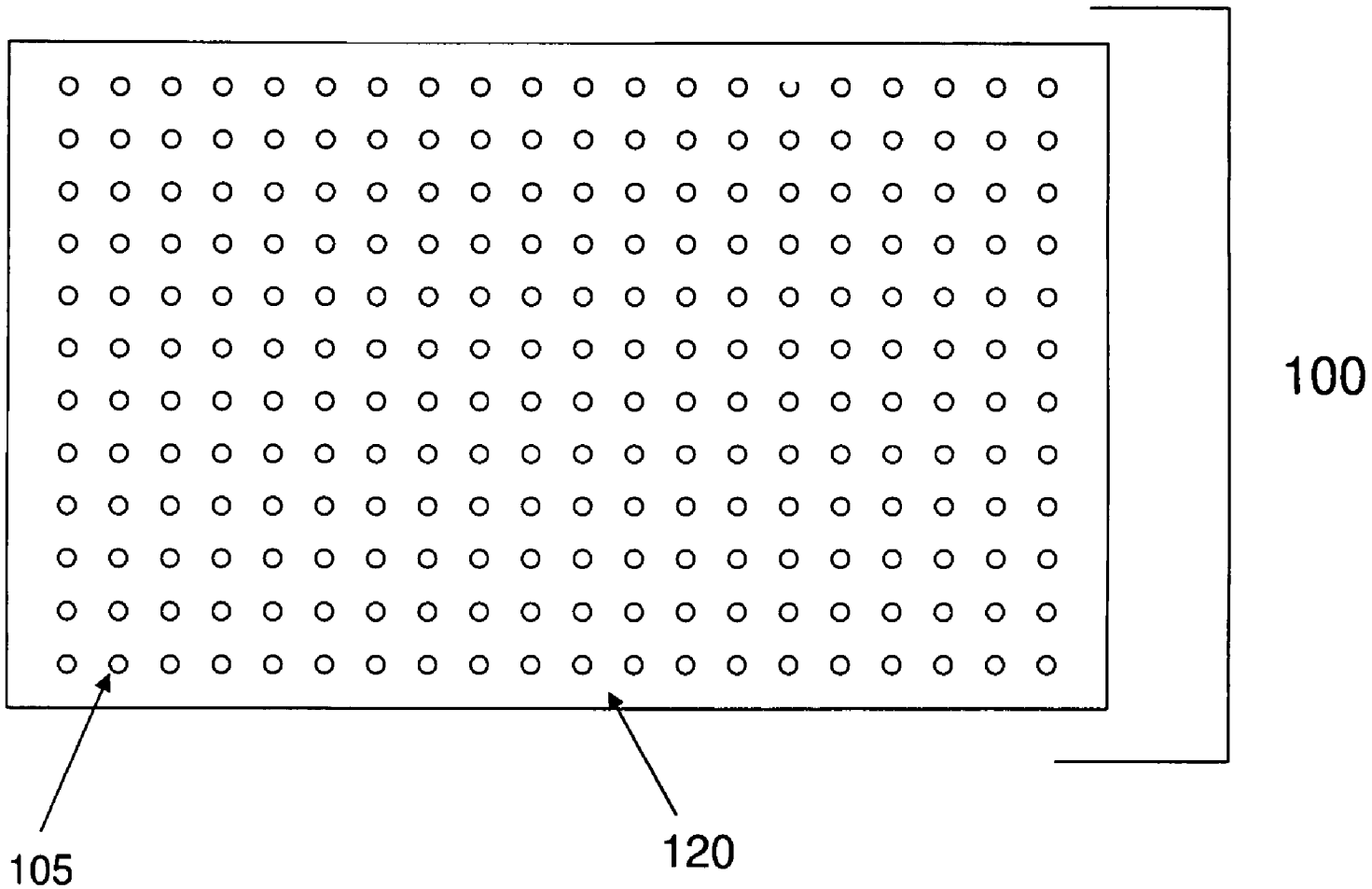
FIG. 1 is a front view of an exemplary backlight.

Turning to the drawings for a better understanding, FIG. 1 shows an embodiment for a backlight 100 using an array of various lights 105. These lights may be any one of the following: LED's, organic light emitting diodes (OLED), field emitting display (FED), light emitting polymer (LEP), and organic electro-luminescence (OEL). The lights are mounted on a mounting element 120. The mounting element 120 may be a printed circuit board with a highly reflective surface so that the luminance from the lights 105 is reflected towards the viewing surface of the display.

In an exemplary embodiment, the mounting element 120 may utilize metal PCB technology to dissipate heat from the lights 105 to the rear surface of the mounting element 120. In this exemplary embodiment, the rear surface of the mounting element 120 may be exposed metal, so that cool air may pass over this rear surface and further dissipate heat from the mounting element 120 and thus from the lights 110. In this exemplary embodiment, there should be a low level of thermal resistance between the chip or die which contains the lights 110 and the exposed rear metal surface of the mounting element 120.

Figure 2:
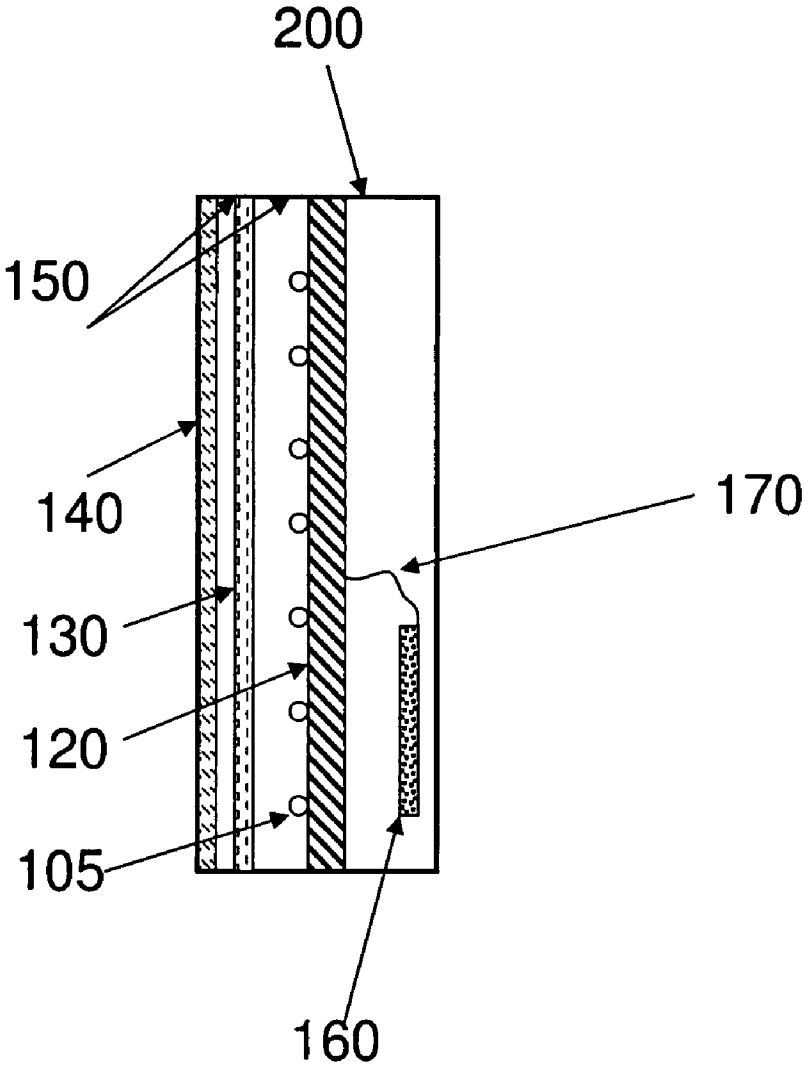
FIG. 2 is a side view of an exemplary embodiment of a static advertising display.

FIG. 2 shows a side view of an exemplary embodiment of a static advertising display. The display housing 200 contains the various components and may be free-standing or mounted on a vertical surface. Lights 105 are again mounted to the mounting element 120. A light diffuser 130 may be placed in front of the lights 105 in order to scatter the light and distribute it across the image assembly 140. The image assembly 140 may comprise a graphic which may be printed onto a substrate. The image assembly 140 may be comprised of several layers of substrate which may polarize light, protect the graphics and/or the display itself, or absorb light. The inner housing surfaces 150 between the lights 105 and the diffuser 130 and between the diffuser 130 and the image assembly 140 may be highly reflective.

Various electronic components 160 may power and control the backlight through electrical connections 170. The various electronic components 160 may comprise a variety of motors, fans, PCB boards, microcontrollers, resistors, capacitors, wiring, power supplies, and power transformers. In an exemplary embodiment, fans (not shown) may be blowing air over the rear surface of the mounting element in order to cool the backlight assembly. It should be noted that the elements shown in FIG. 2 are not necessarily drawn to scale. Specifically, if the display housing 200 is intended to be mounted on a vertical surface, the distance between the outer surface of the image assembly 140 and the vertical mounting surface is preferably less than 4 inches. The spaces between components and the size of the components themselves have been exaggerated for explanatory purposes. In an exemplary embodiment, the distance between the outer surface of the image assembly 140 and the vertical surface 210 would be as small as possible. Using LED's, organic light emitting diodes (OLED), field emitting display (FED), light emitting polymer (LEP), or organic electro-luminescence (OEL) materials for the illumination source allows for a very slim display while still remaining very efficient and bright.

Figure 3B:
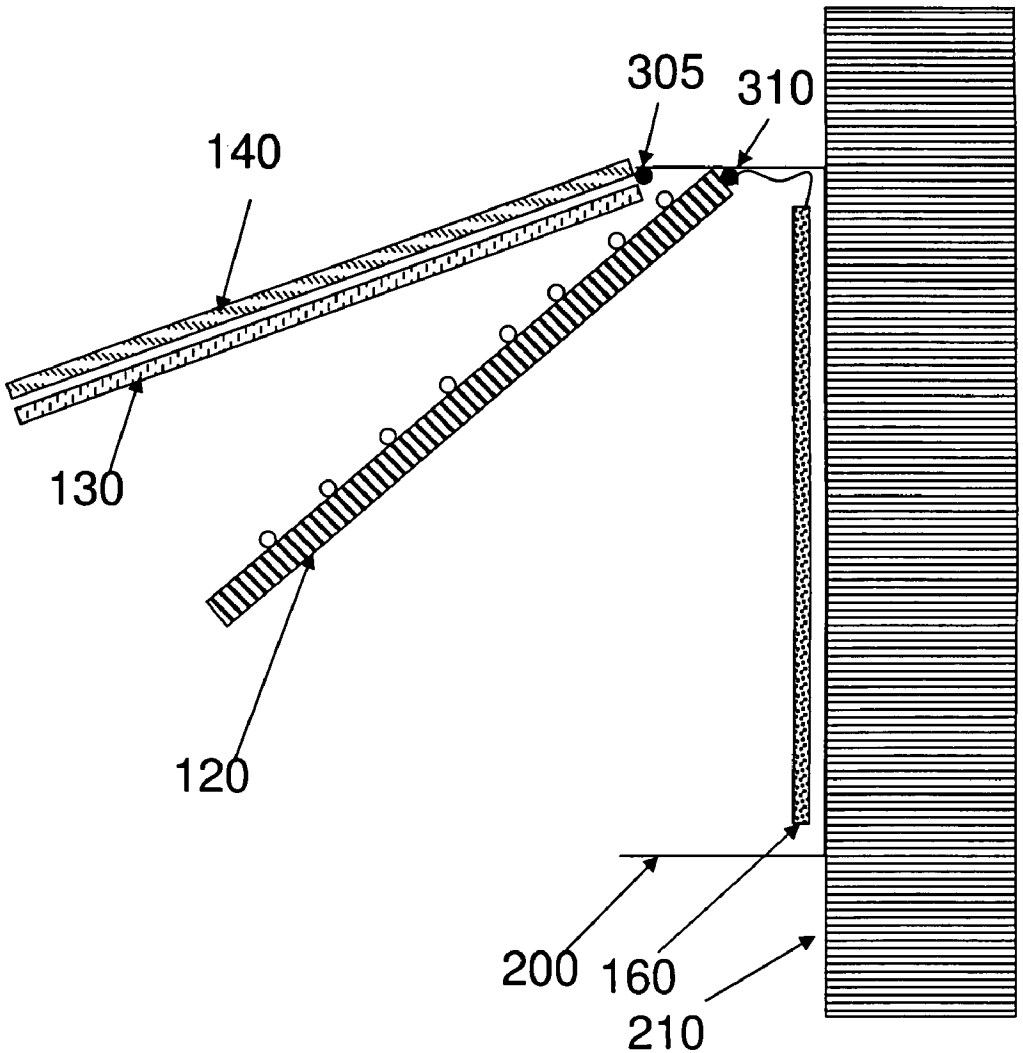
FIG. 3B is a top view of the static advertising display from FIG. 3A where the display housing is opened.
Figure 3A:
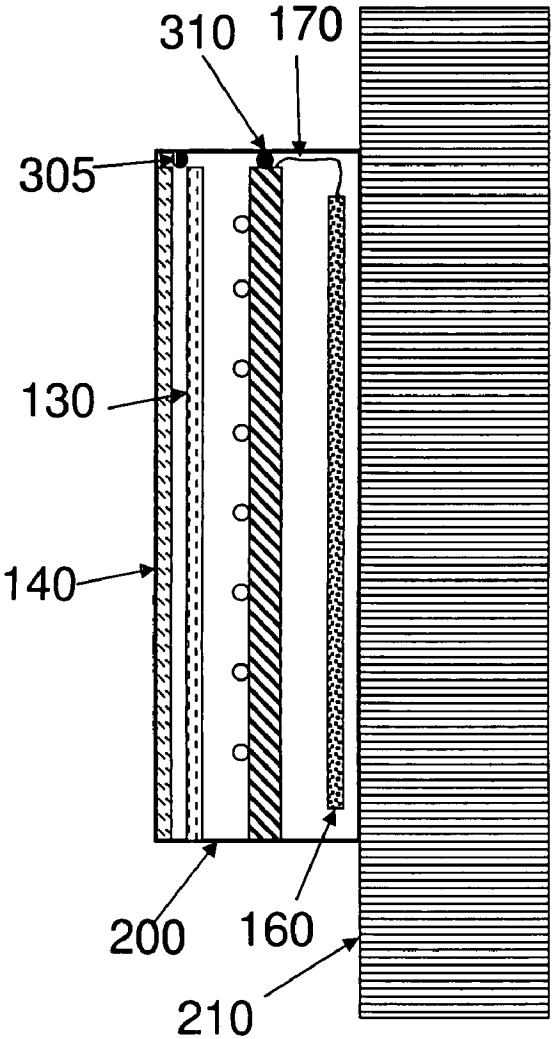
FIG. 3A is a top view of an exemplary embodiment of a static advertising display with the display housing closed.

FIG. 3A shows a top view of a static advertising display when mounted on a vertical surface 210. From this view, the hinges 305 and 310 can be seen. This figure shows the top view where the display housing 200 is closed. FIG. 3B shows the static advertising display from FIG. 2A where the display housing 200 is open. The hinge 305 allows the image assembly 140 and the optional diffuser 130 to rotate outward so that the backlight assembly can be accessed. The hinge 310 may allow the mounting element 120 to also rotate outward so that the various electronic components 160 may be accessed. Allowing these elements to rotate facilitates the servicing of the display without having to remove the display housing 200 from the vertical surface 210. Various components can be repaired or replaced. This is especially beneficial for large displays where removal from the vertical surface may be difficult and/or dangerous. This is also beneficial if practicing the embodiment shown in FIGS. 8A and 8B, where individual tiles of lights may be replaced from the backlight assembly. Of course, some embodiments may not contain the hinges 305 and 310.

Figure 4:
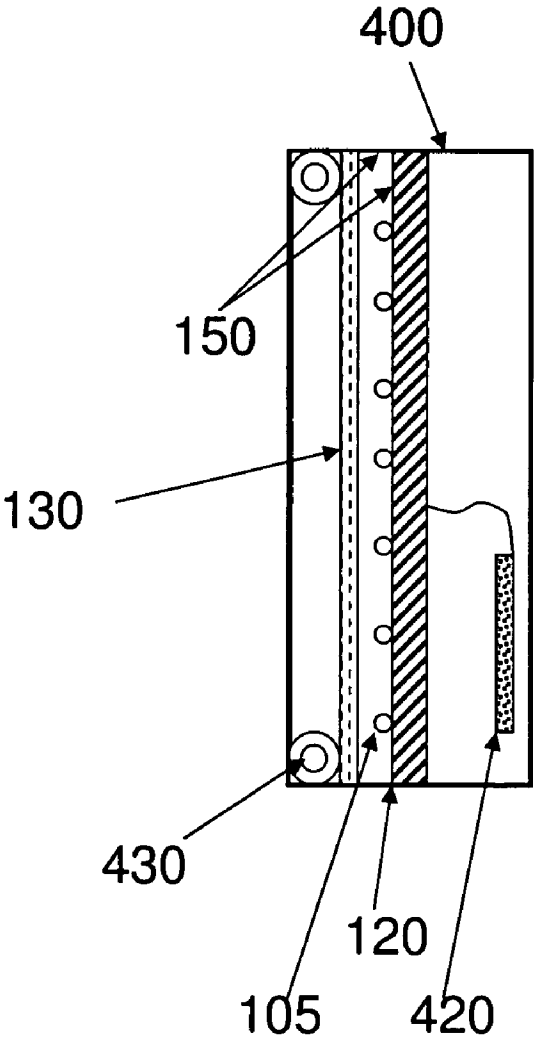
FIG. 4 is a side view of an exemplary embodiment of a dynamic advertising display.

FIG. 4 shows a side view of an exemplary embodiment of a dynamic advertising display. Again, the display housing 400 may be free-standing or may be mounted on a vertical surface. Lights 105 are mounted on the mounting element 120. Various reflective surfaces 150 may be found along the inside of the display housing 400 and the surface of the mounting element 120. A light diffuser 130 may be placed in front of the lights 105 in order to scatter the light and distribute it across the scrolling image assembly 430. The scrolling image assembly 430 is found at the front of the display housing 400 and is adapted to scroll through a plurality of images. The details regarding various embodiments for the scrolling image assembly 430 can be found in U.S. Pat. No. 5,493,802 to Simson, U.S. Pat. No. 5,717,424 to Simson, and U.S. Pat. No. 6,748,685 to Peel. Each one is herein incorporated by reference in its entirety.

Various electronic components 420 are powering and controlling the lights 105 and the scrolling image assembly 430. The various electronic components 420 may also comprise a variety of motors, fans, PCB boards, microcontrollers, resistors, capacitors, wiring, power supplies, and power transformers.

It should again be noted that the elements shown in FIG. 4 are not necessarily drawn to scale. Specifically, if the display housing 400 is intended to be mounted on a vertical surface, the distance between the outer surface of the scrolling image assembly 430 and the vertical mounting surface is preferably less than 4 inches. The spaces between components and the size of the components themselves have been exaggerated for explanatory purposes. Using LED's, organic light emitting diodes (OLED), field emitting display (FED), light emitting polymer (LEP), or organic electro-luminescence (OEL) materials for the illumination source allows for a very slim display while still remaining very efficient and bright.

Figure 5B:
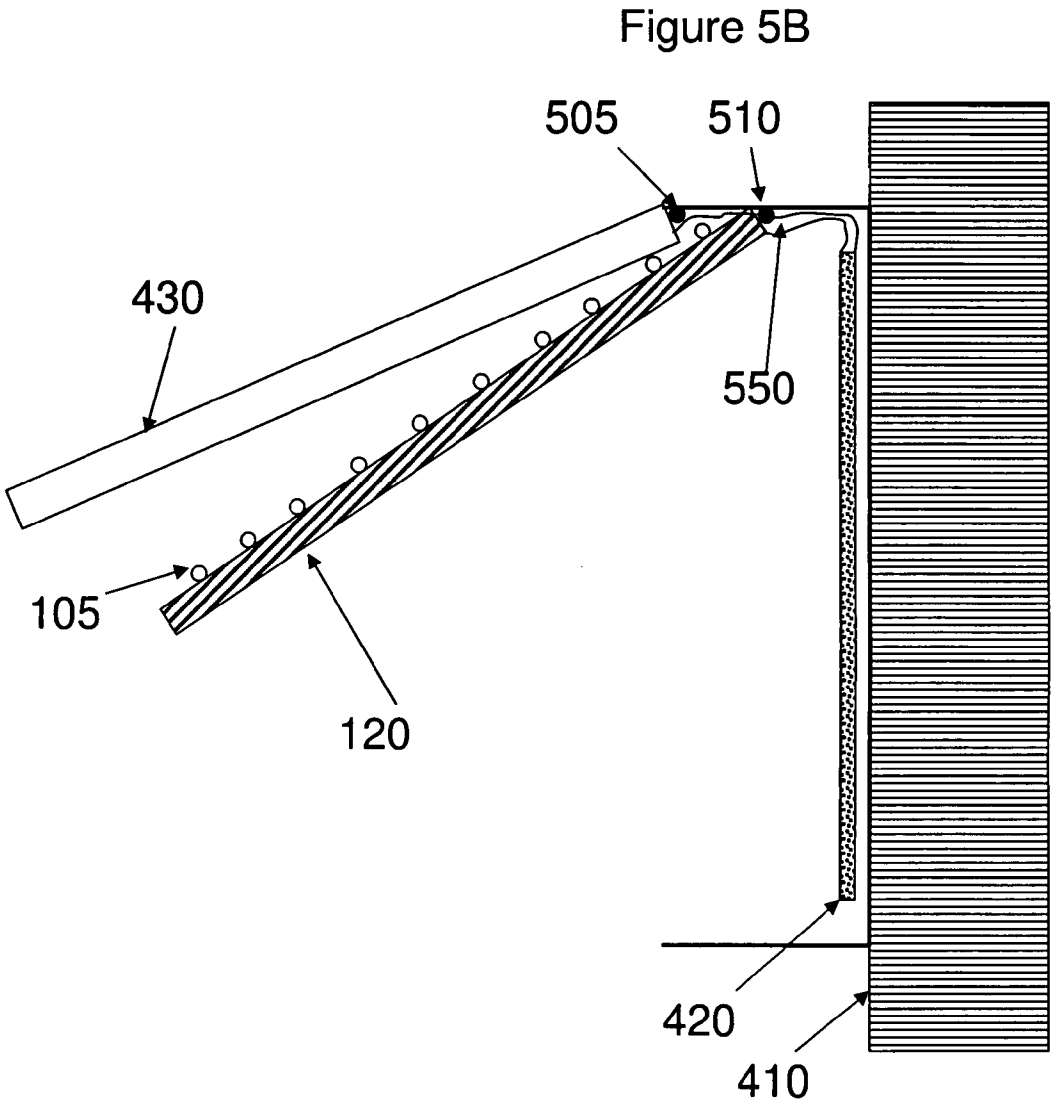
FIG. 5B is a top view of the dynamic advertising display from FIG. 5A where the display housing is open.
Figure 5A:
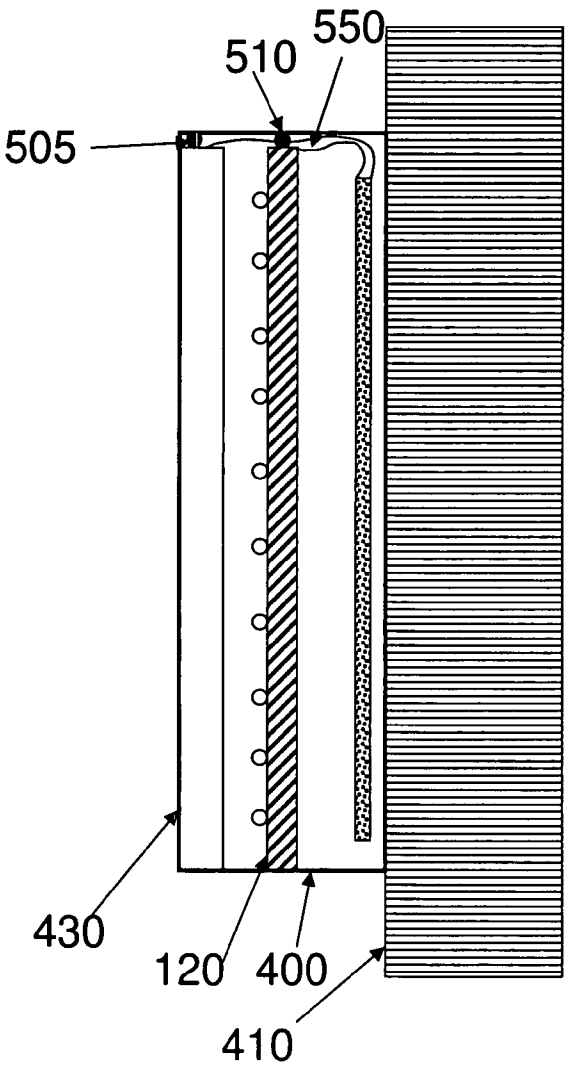
FIG. 5A is a top view of an exemplary embodiment of a dynamic advertising display where the display housing is closed.

FIG. 5A is a top view of a dynamic advertising display where the display is mounted on a vertical surface 410 and where the housing 400 is closed. This embodiment shows the display without the optional light diffusing element. FIG. 5B shows the same dynamic advertising display but where the housing 400 is open. Hinge 505 allows the scrolling image assembly 430 to rotate and hinge 510 allows the mounting element 120 to rotate. Electrical connections 550 maintain electrical connections between the various electronic components 420 and the scrolling image assembly 430 and the lights 105. Again, allowing these elements to rotate facilitates the servicing of the display without having to remove the display housing 400 from the vertical surface 410. Various components can be repaired or replaced. This is especially beneficial for large displays where removal from the vertical surface 410 may be difficult and/or dangerous. Of course, some embodiments may not utilize hinges 505 and 510.

Figures 6A, 6B, 7A, 7B:
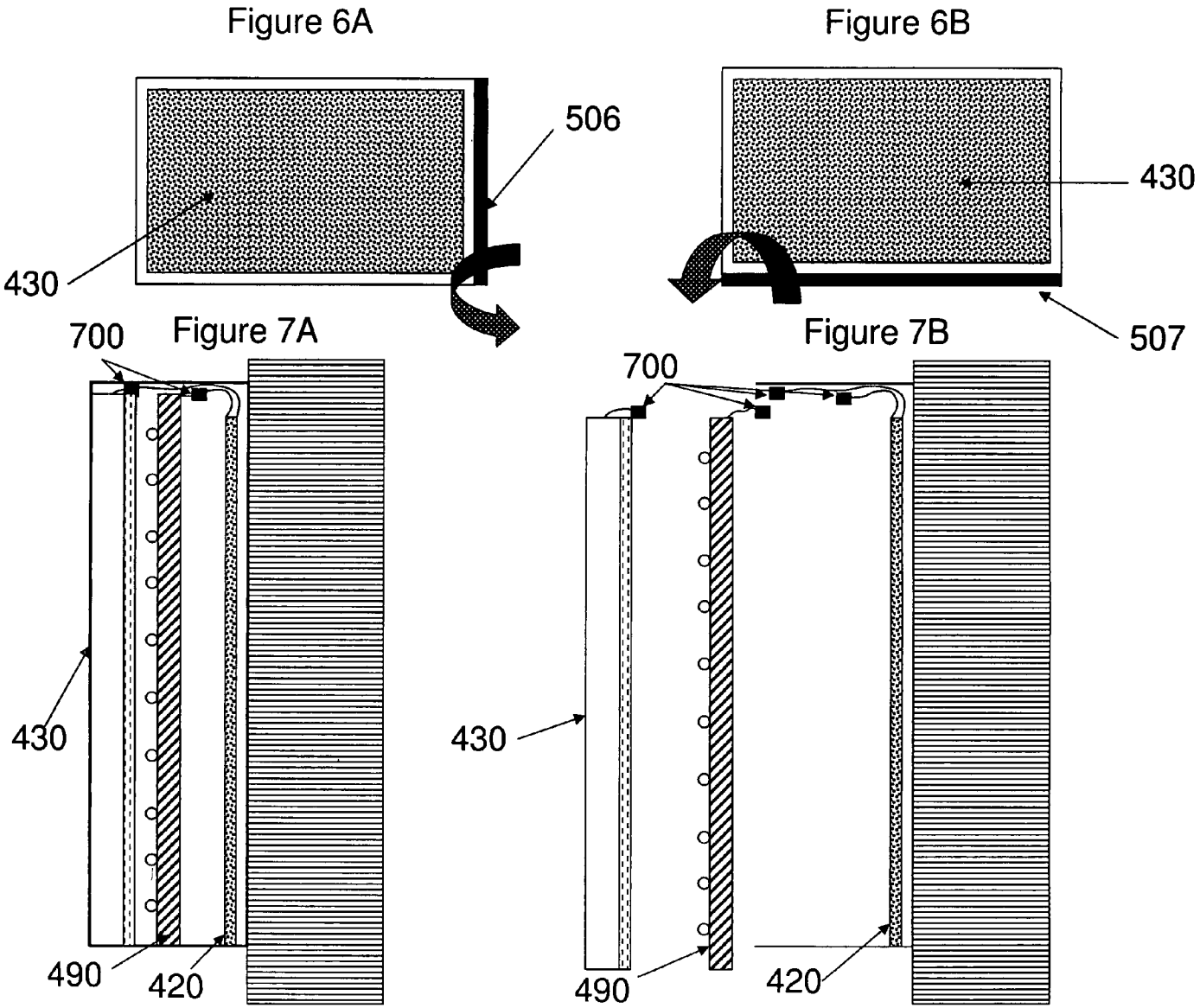
FIGS. 6A and 6B are front views of further embodiments for opening the display housings for static or dynamic displays.
FIG. 7A is a side view for another embodiment for allowing access to the components of the dynamic display where the display housing is closed.
FIG. 7B is a side view of the embodiment shown in FIG. 7A where the display housing is open.

FIG. 6A shows a front view for another embodiment for opening the display housing and allowing access to the internal components. Hinge 506 allows the image assembly 430 to rotate. This is similar to the embodiment shown in FIGS. 5A and 5B except the hinge 506 is on the opposite side of the display. FIG. 6B shows an embodiment where the hinge 507 is along the bottom edge of the image assembly 430. The hinge could also be placed along the top edge of the image assembly 430.

FIG. 7A shows another embodiment where the image assembly 430 and the backlight assembly 490 are connected to the various electronic components 420 using wire harnesses 700. FIG. 7B shows how the image assembly 430 and the backlight assembly 490 can be removed from the display housing so that either assembly can be replaced or repaired. Also, removing the assemblies allows access to the various electronic components 420 so that they also may be repaired or replaced. For large displays, it is advantageous if separate components can be accessed/repaired/replaced without having to replace the entire display or even remove from its mounting upon a vertical surface.

Figure 8A:
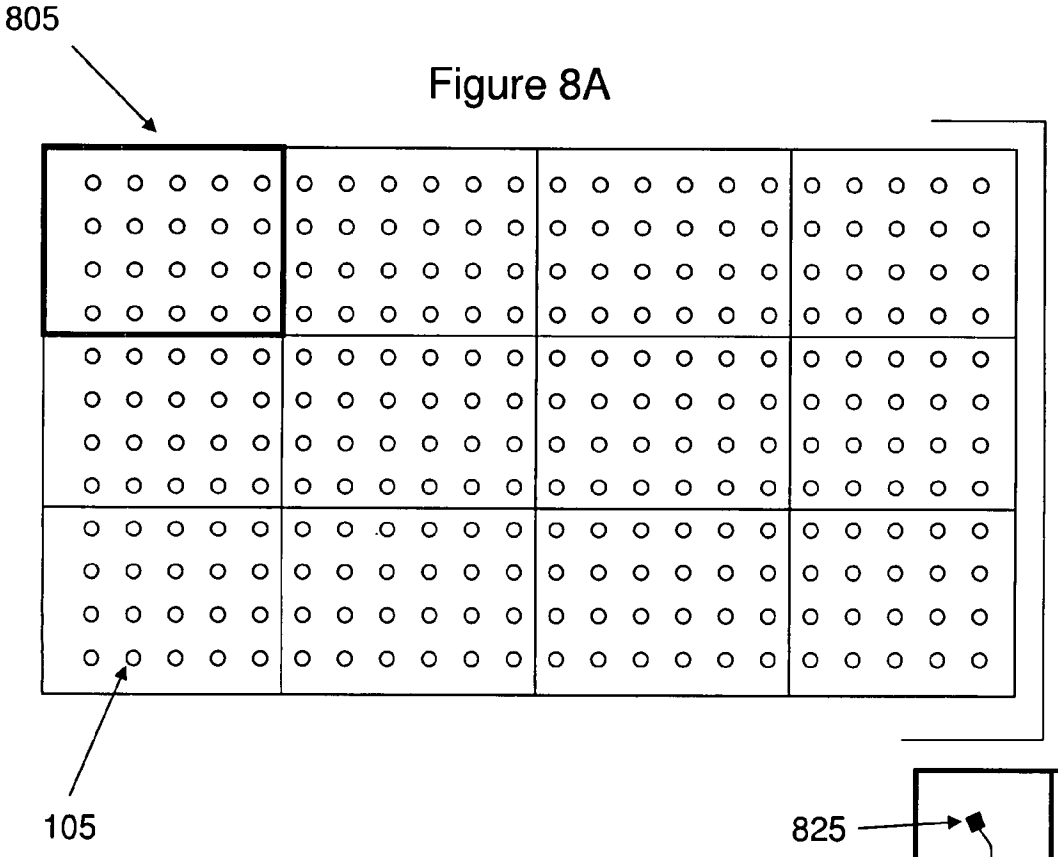
FIG. 8A is a front view for an embodiment of the backlight for a static or dynamic advertising display where the backlight is comprised of a plurality of removable tiles.

FIG. 8A shows the front view of an exemplary embodiment where the backlight assembly 800 is comprised of multiple tiles 805 wherein each tile contains a plurality of lights 105. When a light fails, a single tile may be replaced, rather than having to replace the entire backlight assembly 800. The plurality of tiles 805 may be removably mounted to a mounting structure. This embodiment could be practiced with either the static or dynamic display. Details on a tile system for backlighting an electronic display are disclosed in co-pending Application No. 61/060,504, which is herein incorporated by reference in its entirety.

Figure 8B:
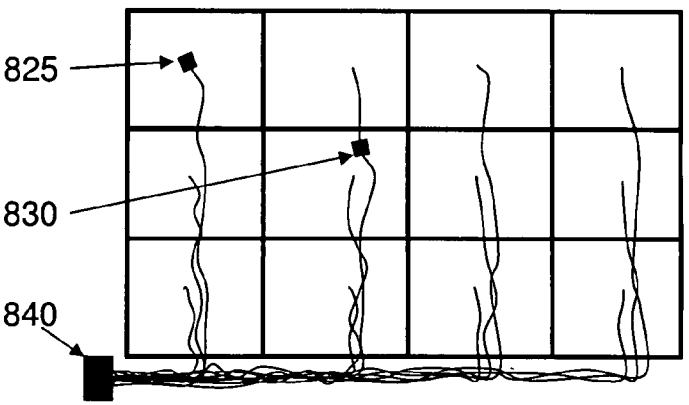
FIG. 8B is a rear view of a removable tile backlight showing several embodiments for electrically connecting backlight tiles.

FIG. 8B shows one embodiment for electrically connecting the various tiles of the backlight assembly. A plug 825 may attach at the back or front of the tile. A wiring harness 830 may be used to connect the tile. The wiring for the tile may connect directly into a controller 840 which may control each tile and may also determine when a tile needs replaced. Tiles could be removed from either the front or rear of the display assembly, depending on the particular application. Tiles which are removable from the front of the display may be more appropriate for displays which are mounted, while tiles which are removable from the rear of the display may be more appropriate for free-standing displays. However, either method of removal is specifically contemplated by both static and dynamic displays.

Figure 9A:
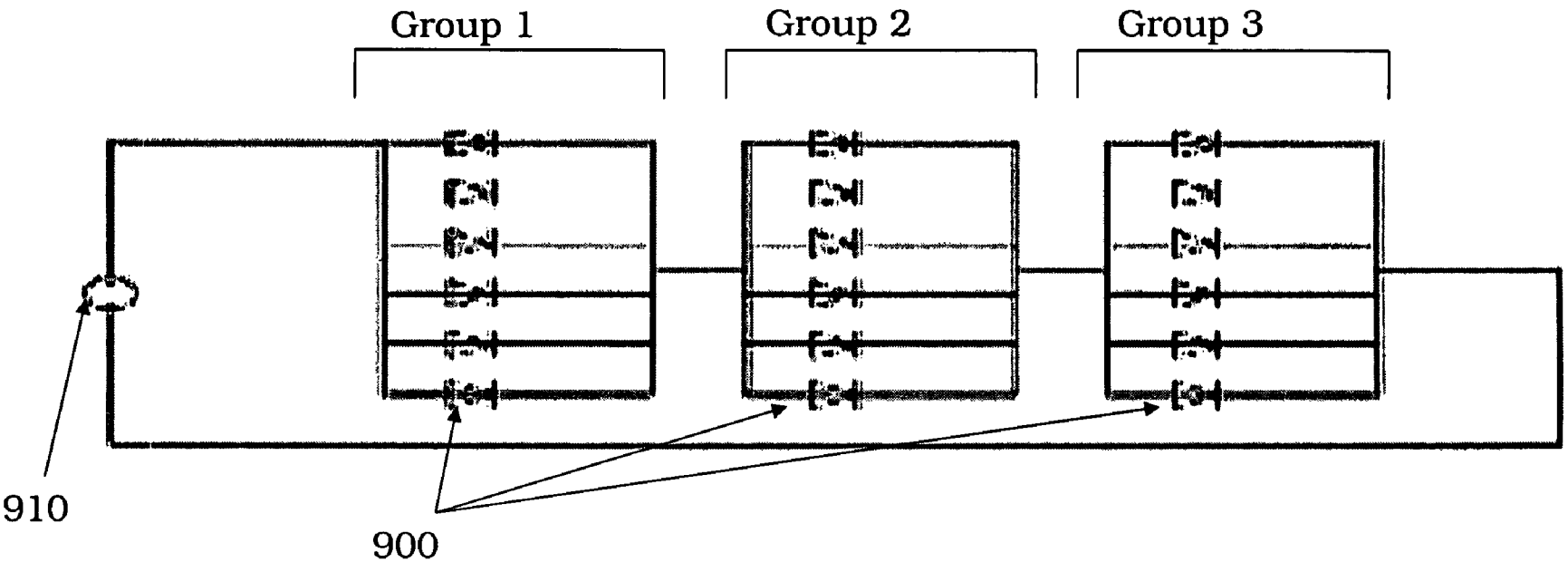
FIG. 9A is a schematic of an exemplary embodiment of a circuit for powering the lights of the backlight.

FIG. 9A shows an exemplary embodiment for powering the plurality of lights in the backlight. In this embodiment, a plurality of lights 900 are electrically connected to a power source 910 in both series and parallel. In this exemplary embodiment, six lights are wired into each of parallel Groups 1 through 3. Each parallel group is then wired in series with one another. Thus, if any one of the lights 900 were to fail, current may pass through any of the other lights within the parallel group, and subsequently through the remaining groups in the series connection. This embodiment may be practiced within each tile or over the entire backlight if the tile method is not being practiced.

It should be noted, that embodiments may contain more or less than six lights in each of the parallel groups. It should also be noted, that embodiments may contain more or less than three parallel groups in series. Furthermore, the circuitry may contain additional elements such as amplifiers, limiters, microprocessors, resistors, capacitors, and measurement devices to further improve the performance of the circuit.

Figure 9B:
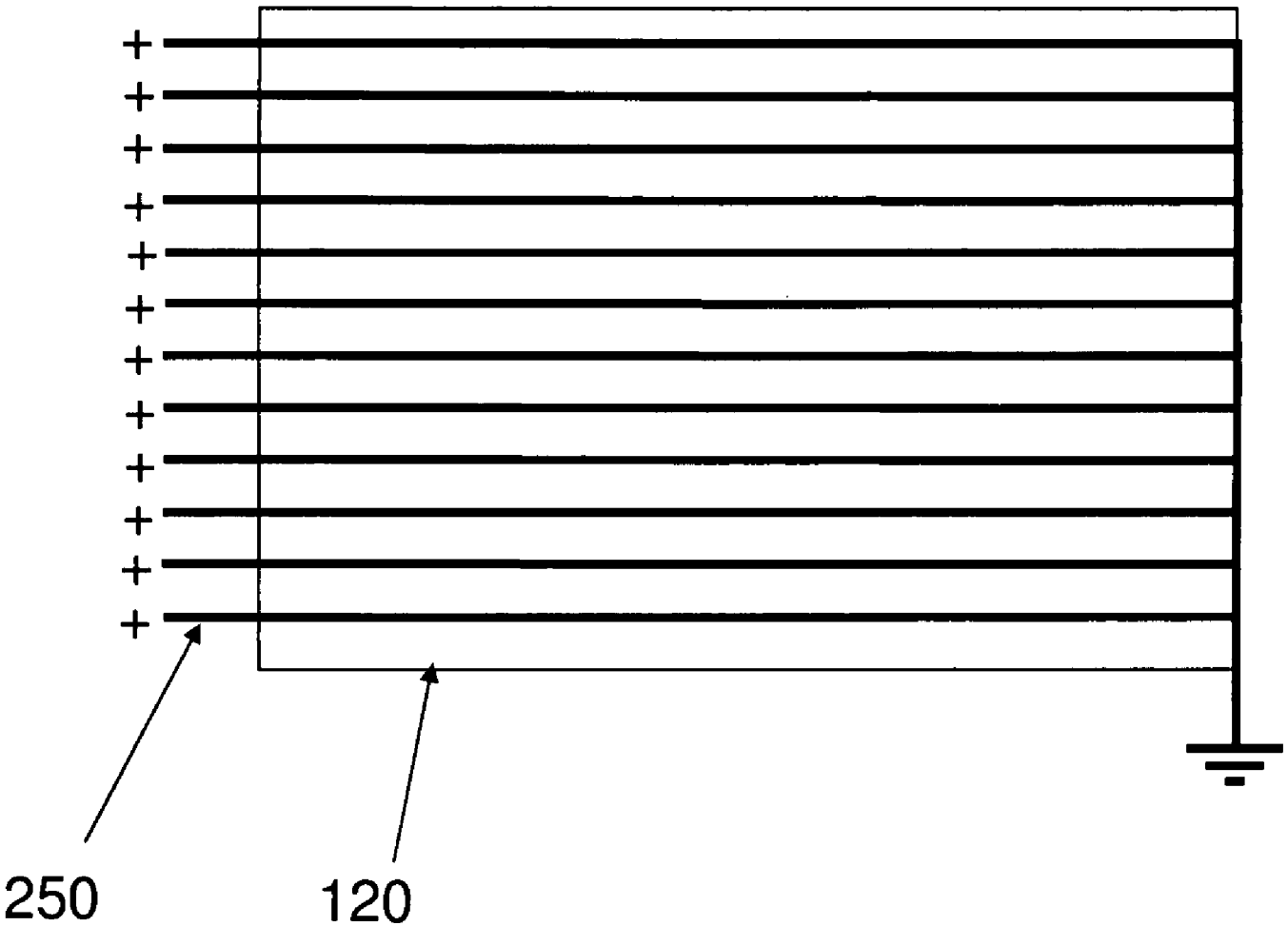
FIG. 9B is a schematic for another embodiment for powering the lights.

FIG. 9B shows another embodiment for distributing power and controlling the lights. An electrically conductive grid 250 is mapped out across the mounting element 120.

Figure 9C:
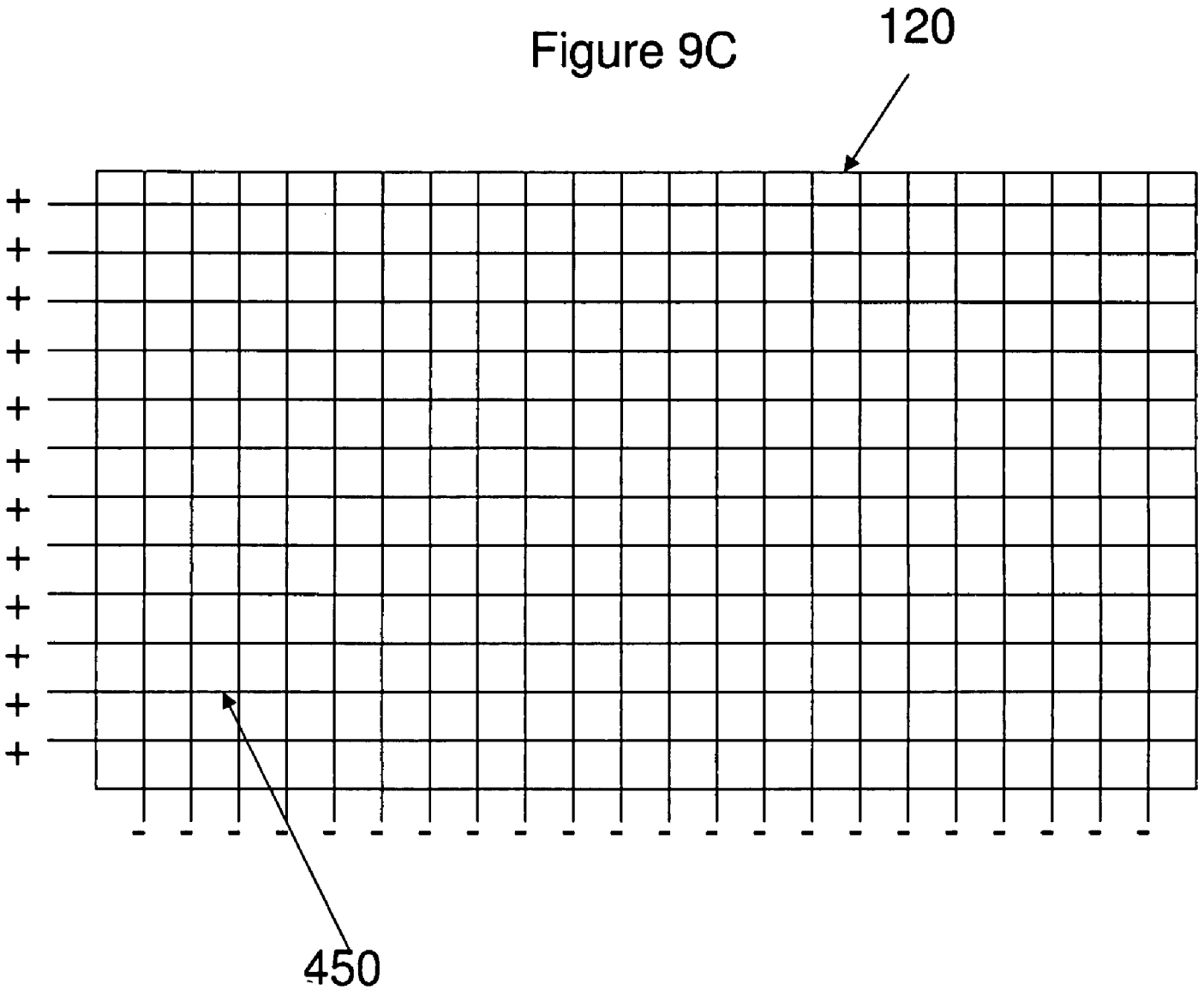
FIG. 9C is a schematic for a further embodiment for powering the lights.

FIG. 9C shows another embodiment for distributing power and controlling the lights 105. A grid of electrically conductive material 450 is again spread across the mounting element 120. Many other methods for distributing power and controlling the lights are also contemplated, and are well known by those skilled in the art.

The mounting element may be a printed circuit board (PCB) and the circuitry may be a portion of the PCB. The PCB may comprise a standard FR4 circuit board. An exemplary embodiment may utilize a low level of thermal resistance between the lights and the rear surface of the PCB. This allows heat to dissipate from the lights to the rear of the PCB where it may be removed from the lighting assembly by convection or conduction or both. An exemplary embodiment may use a metal core PCB for this purpose. The PCB for an exemplary embodiment may contain a metallic rear PCB surface where cooler air may pass over the surface and remove heat from the lighting assembly. This air may be forced over the rear surface of the PCB by one or more fans within the display housing. The rear surface of the PCB may be comprised of aluminum. The surface of the PCB which contains the lights may be coated with a highly reflective coating and may also be of a specific color, depending on the specific requirements for the lighting application.

Embodiments may utilize any one of the following: LEDs, organic light emitting diodes (OLED), field emitting display (FED), light emitting polymer (LEP), and organic electroluminescence (OEL).

Having shown and described preferred embodiments, those skilled in the art will realize that many variations and modifications may be made to affect the described embodiments and still be within the scope of the claimed invention. Additionally, many of the elements indicated above may be altered or replaced by different elements which will provide the same result and fall within the spirit of the described embodiments. It is the intention, therefore, to limit the invention only as indicated by the scope of the claims.

What is claimed is:

1. An advertising display contained within a housing having an inside rear portion and comprising:
- a mounting element hingedly fastened to the housing;
- an image assembly hingedly fastened to the housing and substantially parallel to and substantially aligned with said mounting element;
- a plurality of lights between said image assembly and said mounting element and attached to said mounting element; and
- a means for powering said lights;
- wherein the mounting element and image assembly are adapted to rotate and allow access to the inside rear portion of the housing behind the mounting element.

2. The display from claim 1 wherein said plurality of lights are LEDs.

3. The display from claim 1 wherein:
- said plurality of lights are any one of the following: organic light emitting diodes (OLED), field emitting display (FED), light emitting polymer (LEP), and organic electro-luminescence (OEL).

4. The display from claim 2 wherein said mounting element comprises a printed circuit board (PCB) having a front and rear surface.

5. The display from claim 4 further comprising:
- a light diffuser element between said plurality of lights and said image assembly.

6. The display from claim 4 wherein said PCB is a metal core PCB.

7. The display from claim 1 wherein said means for powering said lights comprises:
- a power source;
- a first group of lights comprising two or more lights connected in parallel;
- a positive conduction line connected to said power source and to said first group of lights;
- a second group of lights comprising two or more lights connected in parallel, wherein said second group of lights is connected in series to said first group of lights; and
- a negative conduction line connected to said second group of lights and returning to said power source.

8. The display from claim 7 further comprising:
- a third group of lights comprising two or more lights connected in parallel; and
- wherein said third group of lights is connected in series to said second group of lights and to said negative conduction line returning to said power source.

9. The display from claim 8 wherein said lights are LEDs.

10. The display from claim 1 wherein said mounting element comprises a plurality of tiles.

11. The display from claim 6 further wherein:
- the rear surface of said PCB is metallic; and
- further comprising a fan directing air over said metallic surface.

12. The display from claim 1 wherein the front surface of the image assembly is less than four inches from a vertical surface when the display is mounted onto the vertical surface.

13. The display from claim 2 wherein the image assembly is a scrolling image assembly.

14. A static advertising display contained within a housing and comprising:

a printed circuit board (PCB) hingedly fastened to the housing and having front and rear surfaces;

a plurality of LEDs attached to the front surface of said PCB;

a static image assembly hingedly fastened to the housing and substantially parallel and substantially aligned with the front surface of said PCB;

a light diffusing element between said plurality of LEDs and said image assembly; and a means for powering said LEDs.

15. The static display from claim 14 wherein said means for powering said LEDs comprises:

a power source;

a first group of LEDs comprising two or more LEDs connected in parallel;

a positive conduction line connected to said power source and to said first group of LEDs;

a second group of LEDs comprising two or more LEDs connected in parallel, wherein said second group of LEDs is connected in series to said first group of LEDs;

a third group of LEDs comprising two or more LEDs connected in parallel, wherein said third group of LEDs is connected in series to said second group of LEDs; and a negative conduction line connected to said third group of LEDs and returning to said power source.

16. The static display from claim 14 wherein said PCB is comprised of a plurality of removable PCB tiles.

17. A dynamic advertising display contained within a housing and comprising:

a printed circuit board (PCB) hingedly fastened to the housing and having front and rear surfaces;

a plurality of LEDs attached to the front surface of said PCB;

a scrolling image assembly hingedly fastened to the housing and adapted so that the current image to be displayed is substantially parallel and substantially aligned with the front surface of said PCB;

a light diffusing element between said plurality of LEDs and said image assembly; and a means for powering said LEDs.

18. The dynamic display from claim 17 wherein said means for powering said LEDs comprises:

a power source;

a first group of LEDs comprising two or more LEDs connected in parallel;

a positive conduction line connected to said power source and to said first group of LEDs;

a second group of LEDs comprising two or more LEDs connected in parallel, wherein said second group of LEDs is connected in series to said first group of LEDs;

a third group of LEDs comprising two or more LEDs connected in parallel, wherein said third group of LEDs is connected in series to said second group of LEDs; and a negative conduction line connected to said third group of LEDs and returning to said power source.

19. The dynamic display from claim 17 wherein said PCB is comprised of a plurality of removable PCB tiles.

* * * * *

UNITED STATES PATENT AND TRADEMARK OFFICE

CERTIFICATE OF CORRECTION

PATENT NO. : 8,016,452 B2
APPLICATION NO. : 12/266749
DATED : September 13, 2011
INVENTOR(S) : William Dunn It is certified that error appears in the above-identified patent and that said Letters Patent is hereby corrected as shown below:

On the title page, item (74) Attorney, Agent, or Firm please delete "Stanley Law Group LLP" and insert -- Standley Law Group LLP --.

Signed and Sealed this
Eighteenth Day of October, 2011

David J. Kappos

David J. Kappos
*Director of the United States Patent and Trademark Office*